US005259620A

United States Patent [19]

Marocco

[11] Patent Number: 5,259,620

[45] Date of Patent: Nov. 9, 1993

[54] GOLD CLUB TRAINING DEVICE

[76] Inventor: Joseph Marocco, 200 Meadow La., Plainfield, Ill. 60544

[21] Appl. No.: 823,862

[22] Filed: Jan. 22, 1992

Related U.S. Application Data

[63] Continuation-in-part of Ser. No. 627,594, Dec. 14, 1990, Pat. No. 5,131,660.

[51] Int. Cl.[5] ..... A63B 69/36

[52] U.S. Cl. ..... 273/186.2; 273/194 R

[58] Field of Search ..... 273/186 R, 186 A, 186 C, 273/162 R, 163 R, 183 R, 194 R

[56] References Cited

U.S. PATENT DOCUMENTS

| | | | |
|---|---|---|---|
| 1,712,537 | 5/1929 | White | 273/186 A |
| 2,630,012 | 3/1953 | Walker | 273/186 A |
| 3,270,564 | 9/1966 | Evans | 273/194 R |
| 3,293,755 | 12/1966 | Cronwell | 273/163 R |
| 3,424,462 | 1/1969 | Driscoll | 273/162 R |
| 3,466,046 | 9/1969 | McTeigue | 273/162 R |
| 5,074,564 | 12/1991 | Rilling | 273/186 A |
| 5,082,283 | 1/1992 | Conley et al. | 273/186 A |
| 5,131,660 | 7/1992 | Marocco | 273/186 A |

*Primary Examiner*—William H. Grieb

*Attorney, Agent, or Firm*—Michael Best & Friedrich

[57] ABSTRACT

A golf club training device is provided having a shaft with a proximal and distal end, a club head fixedly attached to the distal end of the shaft member, and a handle fixedly attached to the proximal end of the shaft member. The club head has a face used for striking the ball. A mechanism is provided for measuring the angle of the shaft relative to horizontal and for audibly indicating when the shaft is in the horizontal position relative to the ground. As a result, when the user addresses the ball with the face of the golf club facing the ball, and then moves the club through the backswing in an arc of 270 degrees, an audible signal is emitted when the shaft reaches the horizontal position.

22 Claims, 2 Drawing Sheets

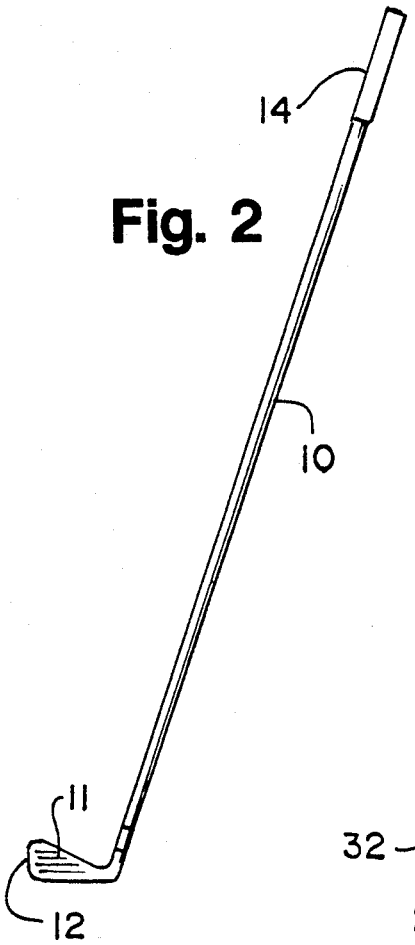
Fig. 2
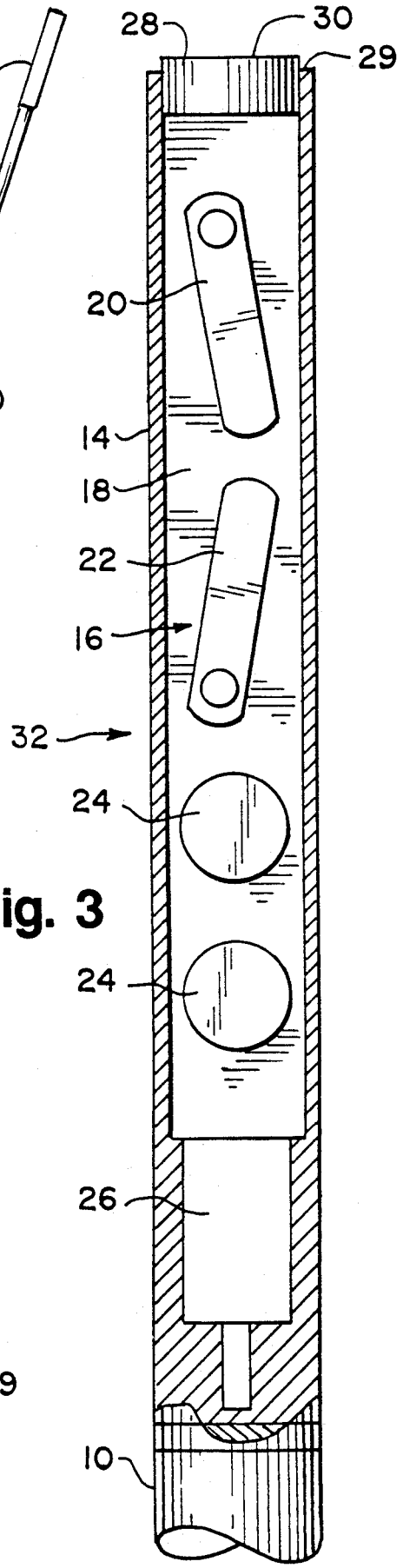
Fig. 3
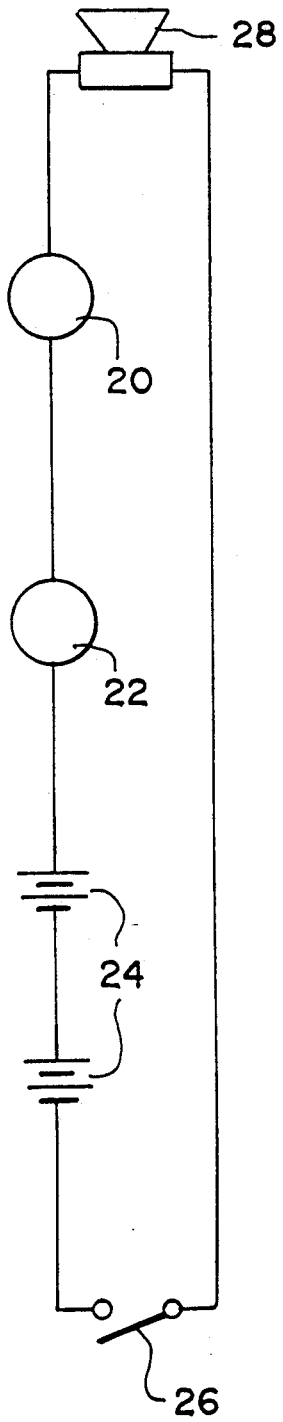
Fig. 4
Fig. 5
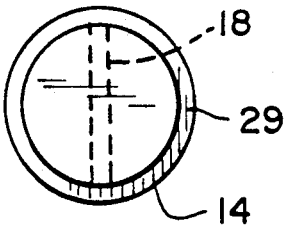

GOLD CLUB TRAINING DEVICE

This invention is a continuation-in-part of U.S. patent application Ser. No. 627,594, filed Dec. 14, 1990, now U.S. Pat. No. 5,131,660 issued Jul. 21, 1992.

The present invention relates generally to golf clubs and more particularly to an improved golf club training device which allows the user to more precisely control the amount of back swing, the club head speed, and the rotation of the club head during use.

BACKGROUND OF THE INVENTION

A wide variety of devices have been developed in order to improve the ability of golfers, in the areas of both driving, chipping and putting. For example, U.S. Pat. No. 2,630,012 discloses a golf club velocity indicating device. The device is adapted to be mounted on the shaft of a golf club such as a driver.

U.S. Pat. No. 3,424,462 discloses a putter and backswing gauge that is mounted on the shaft of the putter. The backswing gauge includes an indicator for assisting in determining the optimum back swing of a putter with relation to the distance between the lie of a ball and the cup. However, this device has been found to be cumbersome because of the rod extending from the putter shaft and the hardware associated with the indicator mounted on the shaft.

U.S. Pat. No. 1,712,537 discloses a speed indicating device for golf clubs.

U.S. Pat. No. 3,270,564 discloses an athletic swing measurement system which incorporates devices for measuring torsion, flex, and acceleration of the golf club. The information is transmitted by a radio transmitter in the golf club to a recording playback console.

Although the previous devices are useful in facilitating golf training, they have not been provided a simple and easy to use device for perfecting a golfer's backswing, consistent club speed and rotation of the club head during use.

Accordingly, it is an object of the present invention to provide a golf club training device that audibly indicates when the user has rotated the shaft of the club to a horizontal position approximately 270 degrees from alignment with the ball.

It is an additional object of the present invention to provide a golf club training that audibly indicates when the golf swing is within a desired speed range.

It is a further object of the present invention to provide a golf club training device that audibly indicates when the club head has been rotated a desired range, preferably about 270 degrees, in order to indicate proper rotation of the club head.

Finally, it is an object of the present invention to provide such a device to the user in a low-cost, simple and highly effective manner.

SUMMARY OF THE INVENTION

A golf club training device is provided having a shaft with a proximal and distal end, a club head fixedly attached to the distal end of the shaft member, and a handle fixedly attached to the proximal end of the shaft member. The club head has a face used for striking the ball A mechanism is provided for measuring the angle of the shaft relative to horizontal and for audibly indicating when the shaft is in the horizontal position relative to the ground. As a result, when the user addresses the ball with the face of the golf club facing the ball, and then moves the club through the backswing in an arc of approximately 270 degrees, an audible signal is emitted when the shaft reaches the horizontal position, indicating that the backswing has been completed. As a result, the user becomes accustomed to effecting a proper backswing.

A mechanism is further provided for measuring the rotation of the club head relative to the vertical position of the club face when addressing the ball. Again, an audible indicator signals when the club head has been rotated approximately 270 degrees, thus showing correct rotation of the user's hands during the backswing.

As a further feature, an electronic mechanism is provided for measuring the speed of the club during swinging. The club speed can then be indicated either using a visual display such as a light-emitting diode or an audible indicator for indicating when the club speed is within the desired range of 45/100 to a full second, depending on one's physical ability.

In a preferred embodiment, the mechanism for measuring the angle of the shaft relative to horizontal includes an electrical circuit having a pair of liquid mercury switches. The first of these switches is activated when the club is elevated 90 degrees (when the backswing goes from addressing the ball to pointing rearwardly from the user.) The second of the switches is activated when the shaft is at the desired horizontal point of the backswing, (pointing towards the direction the ball should travel).

The purpose of the present invention is to train a golfer in the development of a consistent and repetitive horizontal (parallel to the ground) backswing. By repeating the proper position of the backswing, eliminating over and under swinging, and properly positioning the golfer, the result will be the maximum amount of head speed of the golf club. This will reduce the golfer's potential of producing incorrect face angles at impact of the golf club head, and reducing the golfer's potential of hooking and slicing the golf ball in its final result. By developing a grooved, consistent golf swing, a golfer will gain control of the ball for direction as well as distance. When a golfer draws the club back, the objective is to have the club head pointing in the direction of the target. At this maximum point the club shaft is parallel to the ground. This position is a constant on full shots and does not apply to "knock down" shots or situations when a golfer is obviously restricted (in a hazard) in drawing the club back to the horizontal position. The present device allows a golfer to know when the desired position of the back swing has been achieved. As a result the golfer will then be able to learn the feel of the correct backswing. The ultimate goal, through practice, will enable a golfer to overcome the obstacle of an erratic backswing.

BRIEF DESCRIPTION OF THE DRAWINGS

FIG. 2 of the drawings is a schematic diagram showing the golf club training device with the club face facing horizontally, as in position 4 of FIG. 1.

FIG. 3 of the drawings is a vertical section, partially broken away, of the golf training device of the present invention showing in particular a pair of liquid mercury switches, a pair of batteries, an on-off switch and an electric buzzer embedded within the handle of the device.

FIG. 4 of the drawings is an electrical schematic diagram showing the batteries, mercury switches, electric buzzer, and on-off switch of the present device.

FIG. 5 of the drawings is an end view of the golf club training device of the present invention showing in particular a printed circuit board embedded in the handle of the device.

Figure 1:
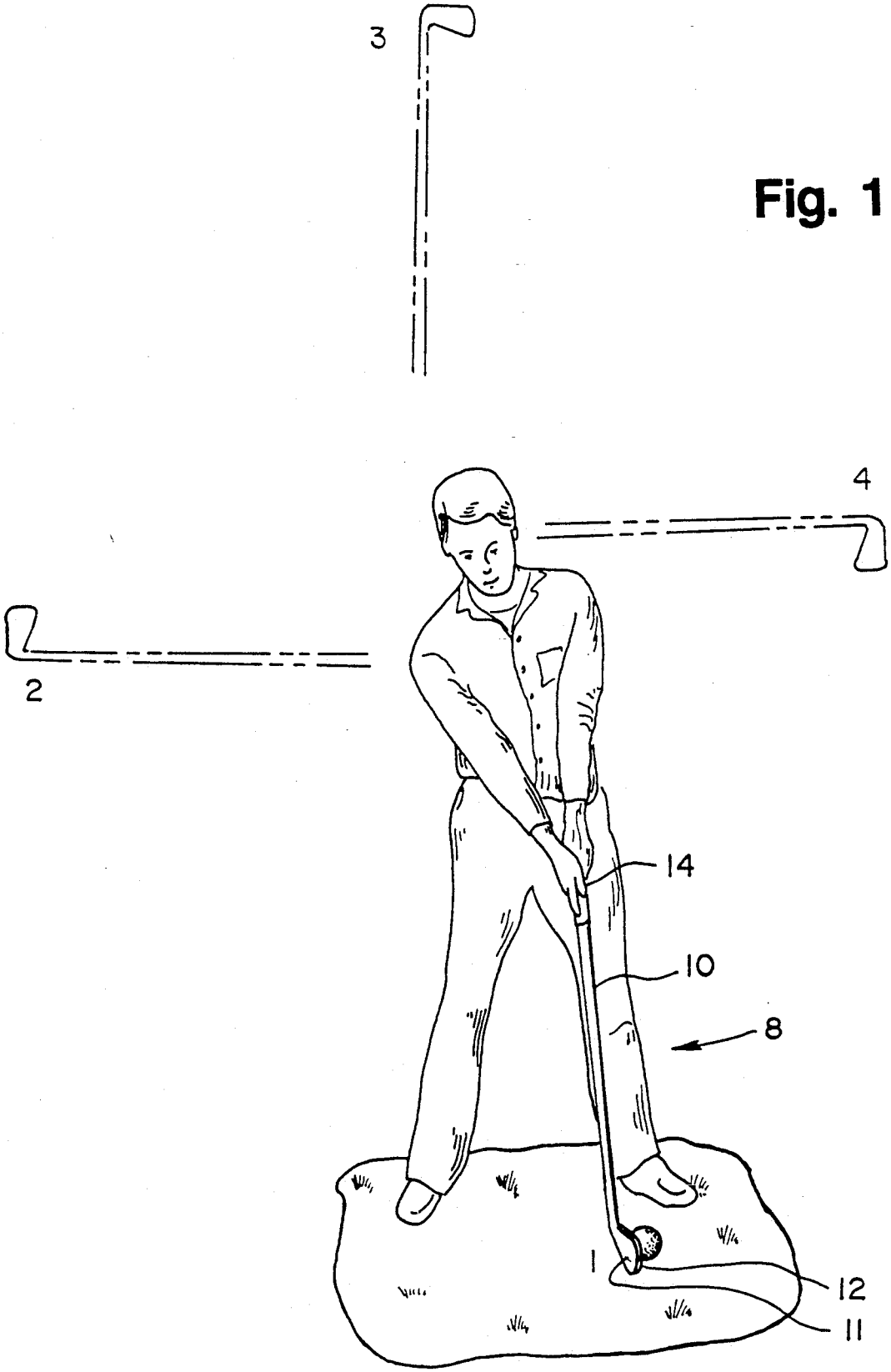
FIG. 1 of the drawings is a schematic diagram showing a golfer swinging a golf club through four positions of the back swing.

DETAILED DESCRIPTION OF THE PREFERRED EMBODIMENT.

An essential key to perfecting one's golf swing relates to the correctness of the back swing. Referring to FIG. 1, a proper golfing back swing should cover approximately a 270 degree arc starting from the initial vertical position (Position 1 in FIG. 1) and ending at an horizontal position above the head and shoulders and parallel to the ground (Position 4 in FIG. 1). Too short a back swing will generally result in a limited overall golf drive while too long a back swing may adversely affect overall swing accuracy.

An additional criterion for proper back swing is to make the club shaft 10 rotate axially during the back swing such that the club face 11 points forward from the golfer by the time the club is at the extreme end of the back swing (Position 4 in FIG. 1). At this point, the club should be oriented as shown in FIG. 2.

An aid towards achieving the correct overall back swing has been developed comprising a golf club device 8 having a shaft 10, a club head 12, and a handle 14. An electronic circuit 16 mounted within the club shaft 10 near the grip or proximal end 29. The electronics 16 consists of a printed circuit board 18 having two mercury switches 20 and 22, (or more if desired), mounted in juxtaposition and connected in series together with a battery source 24, an on-off switch 26 and a piezoelectric beeper 28. (See FIG. 3 for the physical layout of the circuit 16 and FIG. 4 for the electrical interconnection of the components). Other types of microswitches may also be utilized.

The on-off switch 26 is activated by depressing the top 30 of the piezoelectric beeper 28 at the proximal end 30 of the club 32. This will move the entire circuit board assembly 18 and press the on-off switch 26 button against the barrier plug 34. Since this is an on-off type of switch 26, the circuit 16 will be switched alternately on and off during each successive depression.

With the on-off switch 26 in the "on" position and with both mercury switches 20 and 22 engaged, the circuit 16 is energized and the piezo beeper 28 will sound. The mercury switches are so physically arranged that they will be engaged only at a point where the circuit is oriented as shown in FIG. 3. This orientation is the same as that which will occur when the club is at Position 4 in FIG. 1 or as shown in FIG. 2.

As shown in FIG. 3 and the labels "a" and "b" of the individual mercury switches 20 and 22, the relationship of switch closures versus the club back swing positions shown in FIG. 1 is as follows:

| Club Position | Switch a | Switch b |
|---|---|---|
| 1 | o | x |
| 2 | o | o |
| 3 | x | o |
| 4 | x | x |

where "x" indicates a switch closure and "o" indicates an open switch.

From the foregoing, it is clear that the only point at which both switches 20 and 22 are engaged (i.e., closed) is at position 4 which is therefore the only point at which the beeper will sound. Note that the mercury switches are slightly canted in relation to each other. This canting permits, as a practical consideration, some small angular margin about the approximately 270 degree point of the back swing at which the circuit will function.

As indicated above, one of the features of the present invention is its ability to indicate proper rotation of the club head during the backswing. This is accomplished by having the liquid mercury switches 20 and 22 positioned so that they are in the off position when the face of the club head is addressing the ball (Position 1 of FIG. 1). As the club is swung through the backswing, the club head is successively rotated until it comes to rest in Position 4 with the face of the club head facing in the same direction as the golfer. An audible alarm then signals that the club rotation is proper. Alternatively, additional liquid mercury switches (not shown) may be utilized to sense proper rotation of the club head.

An additional aspect of the invention is the ability of the device to measure club speed during both the backswing and the downstroke. This can be accomplished either by utilizing the liquid mercury switches 20 and 22, and sensing their change in electrical conductivity as the club is swung, or other conventional acceleration sensing devices. The speed can then be indicated as a series of beeps or a tone from the piezo electric beeper 28, or other commonly known audible devices such as a bell or horn. Thus, changes in speed will result in a change in tone. A different tone can be used to indicate when the club has been swung to a full backswing position.

FIG. 5 depicts the orientation of the printed circuit board (end view) in the club handle 14 at the approximately 270 degree point of the back swing. This view looks directly at the top or proximal end 26 of the club handle 14. The component side of the pc board 18 is facing to the right as indicated in the sketch. At this position, the circuitry 16 is oriented as shown in FIG. 3 which allows contact closure of both mercury switches 20 and 22. This orientation of the pc board 18 is essential for proper operation of the circuitry 16 when the 90 degree axial rotation of the shaft has occurred. As mentioned above, this 90 degree rotation of the shaft axis is an additional requirement for proper golfing back swing. Unless this rotation occurs, the circuit will not function reliably thereby indicating to the golfer that his back swing is incorrect.

When the club 8 is drawn back, the backswing motion is sensed by two liquid mercury switches 20 and 22. The first switch 20 is activated at the halfway point in the backswing. The second switch 22 is waiting for the liquid to fill up when the backswing has been completed, and then is activated. This activation sends a signal to the piezo buzzer 28 which emits an audible beep. This signal notifies a golfer that he/she has reached the maximum horizontal position (parallel to the ground)in the backswing. The liquid mercury switches 20 and 22, circuits 16, and piezo meter 17 are encompassed by a printed circuit board 18. The switch 26 will be located on the outside of the club and can be switched on or off as needed.

In an alternative embodiment of the invention, the amount of backswing may be measured using a pendulum and an electric sensing mechanism, as disclosed in parent application Ser. No. 07/627,594. In an additional alternative embodiment of the invention, a microprocessor (not shown), may be incorporated in the shaft and electrical signals from the microswitches utilized to provide data as to the position, rotation and speed of the club head. This information may then be used to signal the buzzer 28 when an audible signal is required.

In an additional alternative embodiment of the invention, the mechanism for determining the position of the shaft relative to the ground, and the amount of rotation of the club head 14 may comprise a gyroscope mounted in the shaft. A microprocessor or other simple electronic circuit using microswitches 20 and 22 may then be utilized to trigger buzzer 28. Alternatively, a source of infrared light may be directed from the area near the club head to the ground, and then the reflected infrared light received by a lense on the club. The angle of reflection may be measured and used to determine the position of the club relative to the ground.

An additional aspect of the invention is the ability of the device to be programmed to beep at selected degrees along the arc of the backswing, as seen in FIG. 1. For example, a four way switch may be provided as part of on off switch 26. When this switch is set in the first position, the beeper 28 beeps when the shaft has reached position 1 if FIG. 1, (90 degrees from vertical). Similarly, the switch can be set to beep when the club reaches positions 2, 3 and 4. As a result, golf club device 8 may be constructed as a wedge type club, and the user taught to effect a backswing of 25%. 50%, 75% or 100% of a full backswing. These positions, when used with a constant club speed, will result in chip shots of approximately 25 yards, 50 yards, 75 yards and 100 yards.

One aspect of the mounting of the piezo buzzer 28 should be noted. If the buzzer is fixedly mounted, it will not operate. Accordingly, a plastic tube or other mounting device may be utilized proximate the proximal end 26 of the handle 14. The buzzer 28 is positioned in a hole in the center of the tube and extends there, which allows it to vibrate when actuated.

A final consideration relates to proper club back swing speed. Generally, for most golfers, the back swing should be executed in a relatively slow and deliberate manner (as related to the forward swing) to achieve proper drive accuracy and uniformity. The circuit as described will function correctly for back swing periods of approximately 600 ms or longer which is acceptable—and generally desirable—for golfers who are at the beginner to intermediate skill level. Excessively fast or erratic back swings will result in unpredictable performance of the circuit herein described and serves as an indication to the golfer that his back swing speed should be reduced.

What is claimed is:

1. A golf club training device comprising:

a shaft member having a proximal end and a distal end; a club head having a face, said club head being fixedly attached to the distal end of said shaft member;

a handle member fixedly attached to the proximal end of said shaft member;

means for measuring the angle of said shaft relative to horizontal; and means for audibly indicating when said shaft is in a horizontal position relative to the ground.

2. The golf club training device of claim 1 and further comprising:

means for measuring the rotation of said club head relative to when said face of said club head is in a vertical position; and means for audibly indicating when said club head has been rotated approximately 270 degrees relative to said vertical position.

3. The device of claim 1 wherein said means for measuring the angle of said shaft relative to horizontal comprises:

an electrical circuit having a source of electrical current connected to a pair of liquid mercury switches, the first of said switches being activated at an elevation of 90 degrees and the second of said switches being activated when said shaft is at the desired horizontal point of the backswing.

4. The device of claim 3 and further including a buzzer which buzzes when said shaft is at the desired horizontal point of the backswing.

5. The device of claim 3 and further comprising a switch for selectively activating said electrical circuit and a battery for providing electrical current to said electrical circuit.

6. The device of claim 5 wherein said switch is mounted at the proximal end of said shaft.

7. The device of claim 3 wherein said electrical circuit is contained on a printed circuit board mounted within said shaft.

8. The device of claim 3 wherein said first and second liquid switches are disposed at 90 degrees to each other whereby said club head must be rotated approximately 270 degrees to switch both mercury switches on, thereby indicating proper rotation of said club head.

9. The device of claim 3 wherein said electrical circuit further include means for measuring the change in electrical conductivity of said liquid mercury switches during rotation of said shaft; and means for converting said change in electrical conductivity into an indicator of the speed of said club.

10. The device of claim 1 wherein said means for measuring the angle of said shaft relative to horizontal comprises a pendulum mounted within said shaft and an electrical circuit for measuring the rotation of said pendulum.

11. The device of claim 1 and further comprising: switching means for selectively actuating said audible indication means when said shaft is in a plurality of selected angular positions.

12. The device of claim 11 wherein said switching means comprises a four position switch adapted to actuate said audible indication means when said club is swung in backswings of $\frac{1}{4}$, $\frac{1}{2}$, $\frac{3}{4}$ and full backswings, so as to allow training of a golfer in use of a wedge type clubs for chipping.

13. The device of claim 1 and further comprising means for determining the angle of said club head;

means for determining the speed of said club head; and means for indicating the angle of said club relative to horizontal; the rotation of said club head and the speed of said club during swinging thereof.

14. The device of claim 1 and further comprising a microprocessor containing programming as to desired shaft position, club head rotation and club speed, and means for audibly indicating use of said golf training device within said parameters or outside of said parameters, as desired.

15. The device of claim 1 wherein said means for measuring the angle of said shaft relative to horizontal comprises a gyroscope mounted within said shaft.

16. The device of claim 1 wherein said means for measuring the angle of said shaft relative to horizontal comprises a source of infrared light directed from proximate said club head to the ground, means for receiving reflected infrared light from said source, and means for calculating the angle of said club headrelative to the grtound from the angle of reception of said infrared light.

17. The device of claim 1 and further including a buzzer which buzzes when said shaft is at the desired horizontal point of the back swing.

18. The golf club training device of claim 1 and further comprising a buzzer which buzzes when said club has been rotated 270° relative to said vertical position.

19. A golf club training device comprising:

a shaft member having a proximal end and a distal end;

a club head having a face, said club head fixedly attached to the distal end of said shaft member;

a handle member fixedly attached to said proximal end of said shaft member; means contained within said club for measuring the speed of said club during swinging of said club; and means contained within said club for audibly indicating said speed.

20. The golf training device of claim 19 wherein said means for indicating said speed comprises: an audible indicator actuated when said swing is within a desired range.

21. The golf training device of claim 19 wherein said means for indicating said speed comprises:

a visual indicator for displaying the speed of said club.

22. A golf club training device comprising:

a shaft member having a proximal end and a distal end;

a club head having a face fixedly attached to the distal end of said shaft member;

a handle member fixedly attached to the proximal end of said shaft member; means for measuring the rotation of said club head relative to when said face of said club head is in a vertical position; means for audibly indicating when said club head has been rotated approximately 270 degrees relative to said vertical position.

* * * * *